US007893671B2

(12) United States Patent
Sahni et al.

(10) Patent No.: US 7,893,671 B2
(45) Date of Patent: Feb. 22, 2011

(54) REGULATOR WITH IMPROVED LOAD REGULATION

(75) Inventors: Paramjeet Singh Sahni, Bangalore (IN); Gangaikondan Subramani Visweswaran, New Delhi (IN)

(73) Assignee: Texas Instruments Incorporated, Dallas, TX (US)

( * ) Notice: Subject to any disclaimer, the term of this patent is extended or adjusted under 35 U.S.C. 154(b) by 416 days.

(21) Appl. No.: 12/042,339

(22) Filed: Mar. 5, 2008

(65) Prior Publication Data

US 2008/0224679 A1 Sep. 18, 2008

(51) Int. Cl.
*G05F 1/40* (2006.01)

(52) U.S. Cl. ..... 323/280; 323/275

(58) Field of Classification Search ..... 323/273–275, 323/280, 312–316; 327/538–543
See application file for complete search history.

(56) References Cited

U.S. PATENT DOCUMENTS 5,471,169 A * 11/1995 Dendinger ..... 327/563
5,770,968 A * 6/1998 Cameron ..... 327/538
5,892,376 A * 4/1999 Tabatabai et al. ..... 327/73

OTHER PUBLICATIONS

Slew Rate Enhancement Technique for CMOS Output Buffers, Sep. 14, 1989, pp. No. 1304 to 1305, vol. 25, No. 19.

* cited by examiner

*Primary Examiner*—Jessica Han
(74) *Attorney, Agent, or Firm*—Mirna Abyad; Wade J. Brady, III; Frederick J. Telecky, Jr.

(57) ABSTRACT

A regulator to provide an output voltage of a constant level at an output node. In an embodiment, the regulator contains a pass transistor to provide a conductive path between a pair of terminals, with the resistance offered by the path being determined by a control voltage on a third terminal of the pass transistor and the conductive path coupling a first reference potential (e.g., power supply) to the output node. An amplifier generates the control voltage based on a difference of a reference voltage and a voltage proportionate to the output voltage. A control unit turns on a current source when the voltage at the output node is below the desired constant level and turns on a current sink when voltage at said output node is above the constant level, to quickly correct for any variations in the output voltage due to load changes.

8 Claims, 4 Drawing Sheets

REGULATOR WITH IMPROVED LOAD REGULATION

RELATED APPLICATION(S)

The present application claims priority from co-pending India provisional application serial number: 509/CHE/2007, entitled: "Dynamically Switching Current Sources and Sinks for Improved LDO Load Regulation", filed on:", filed on Mar. 12, 2007, naming Texas Instruments Inc. (the intended assignee) as the Applicant, and the same inventors (Paramjeet Sahni, Gangaikondan Subramani Visweswaran) as in the subject application as inventors, attorney docket number: TXN-914, and is incorporated in its entirety herewith.

BACKGROUND

1. Field of the Technical Disclosure

The present disclosure relates generally to regulators, and more specifically to a regulator with improved load regulation.

2. Related Art

A regulator ideally supplies a voltage of a constant strength as an output, typically based on an external power source. Such constant voltage is often used as a power supply by various types of components/devices/systems, etc., as is well known in the relevant arts. As is also well known, the output of the regulator is referred to as a regulated power supply. Load regulation is the capability to maintain a constant voltage level at the output despite changes in load current (also referred to as 'load').

Load regulation needs to be performed taking into consideration several challenges. For example, one or more corresponding circuit portions of a device/system receiving an output voltage of a regulator act as a load (impedance) to the regulator, and may draw current from the source. Thus, regulators ideally need to maintain a constant output voltage level despite changes in load.

It is desirable that a regulator have good load regulation capability. Further, it is also desirable that load regulation be provided such that variations in output voltage due to changes in load be corrected as quickly as possible.

BRIEF DESCRIPTION OF THE DRAWINGS

The present invention will be described with reference to the following accompanying drawings, which are described briefly below.

In the drawings, like reference numbers generally indicate identical, functionally similar, and/or structurally similar elements. The drawing in which an element first appears is indicated by the leftmost digit(s) in the corresponding reference number.

DETAILED DESCRIPTION

1. Overview

A regulator to provide an output voltage of a constant level at an output node. In an embodiment, the regulator contains a pass transistor to provide a conductive path between a pair of terminals, with the resistance offered by the path being determined by a control voltage on a third terminal of the pass transistor and the conductive path coupling a first reference potential (e.g., power supply) to the output node.

An amplifier generates the control voltage based on a difference of a reference voltage and a voltage proportionate to the output voltage. A control unit turns on a current source when the voltage at the output node is below the desired constant level and turns on a current sink when voltage at said output node is above the constant level, to quickly correct for any variations in the output voltage due to load changes.

Several aspects of the invention are described below with reference to examples for illustration. It should be understood that numerous specific details, relationships, and methods are set forth to provide a full understanding of the invention. One skilled in the relevant art, however, will readily recognize that the invention can be practiced without one or more of the specific details, or with other methods, etc. In other instances, well known structures or operations are not shown in detail to avoid obscuring the features of the invention.

2. Example Environment

Figure 1:
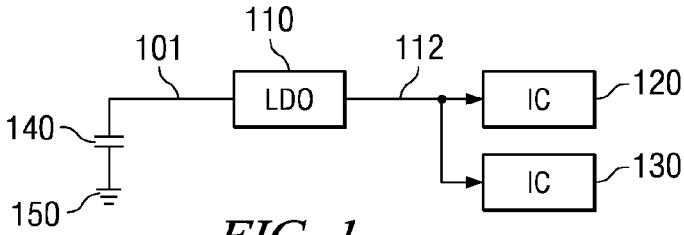
FIG. 1 is a block diagram of an example environment in which several aspects of the present invention can be implemented.

FIG. 1 is a block diagram of an example environment in which several aspects of the present invention can be implemented. The diagram is shown containing low-drop out regulator (LDO) 110, and integrated circuits (IC) 120 and 130. Each component is described below.

LDO 110 represents a regulator, and generates a regulated power supply voltage (output voltage) on node 112 (ideally maintained constant against variations in load, signal strength provided by input power supply 140, etc), from a power source 140 received as input on path 101. Although power source 140 is shown in FIG. 1 as a battery, other types of sources may also be used.

ICs 120 and 130 may correspond to any circuit (e.g., memory, processor, analog circuits, etc.), and receive a power supply for operation via path (node) 112. Circuits internal to ICs 120 and 130 act as a load to output voltage 112.

As noted above, when the load changes (i.e., the current drawn from output node 112), the output voltage may also change, and it is desirable that LDO 110 operate to quickly adjust the output voltage back to the desired constant level.

Several aspects of the present invention provide a regulator that provides load regulation by quickly correcting for changes in output voltage due to changes in load. The features of the invention will be clearer in comparison to a prior regulator described next.

3. Prior Regulator

Figure 2:
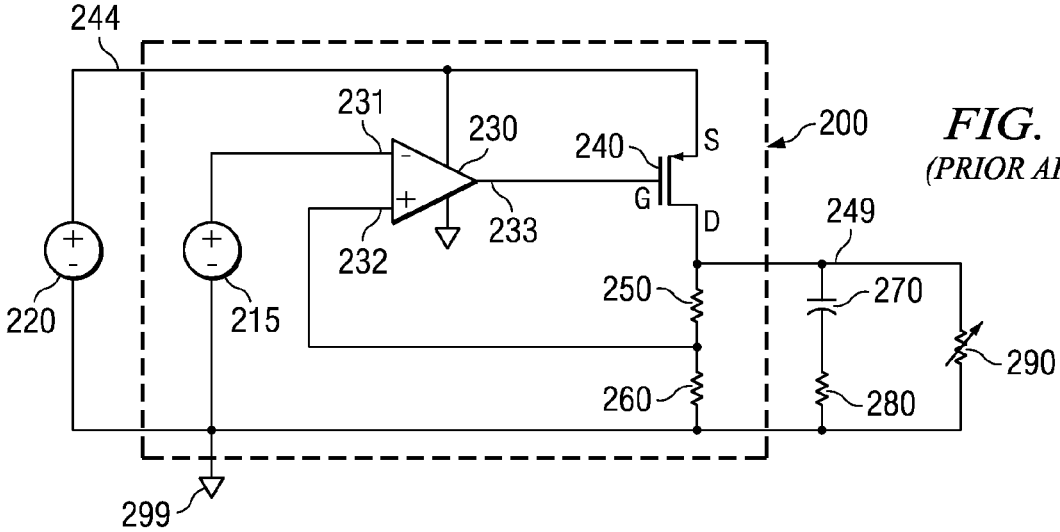
FIG. 2 (PRIOR ART)
FIG. 2 is a block diagram of a prior regulator.

FIG. 2 is a block diagram illustrating the use of a prior regulator in an embodiment.

The diagram is shown containing prior regulator (LDO) 200, external power source 220, external capacitor 270, resistors 280 and 290. Resistor 280 represents the effective series resistance (ESR) of capacitor 270. Variable resistor 290 represents the variable load presented to the output (output node 249) of LDO 200. With respect to FIG. 1, resistor 290 may represent the combined load presented by ICs 120 and 130. Terminal 299 represents ground (or a fixed reference potential). The components of FIG. 2 are described next.

External power supply source 220 may be a battery or other source of DC power, and provides a (unregulated) power supply voltage on path 244.

LDO 200 receives the unregulated supply voltage on path 244, and provides a regulated output voltage on path 249. LDO 200 is shown containing voltage reference 215, amplifier 230, pass transistor 240, and resistors 250 and 260.

Reference 215 generates a fixed reference voltage on input terminal 231 (non-inverting) of amplifier 230. The reference voltage on terminal 231 is smaller in value than the voltage on path 244, and may be derived (although not shown in FIG. 2) from voltage 244. Reference 215 can be generated using various well known techniques such as those based on bandgap regulators.

Pass transistor 240 is shown with a source terminal (S) connected to path 244, drain terminal (D) connected to output node 249, and a gate/control terminal (G) connected to output terminal 233 of amplifier 230.

Amplifier 230 (which may be implemented as an operational amplifier—OPAMP) receives reference voltage 215 on terminal 231, a feedback voltage on another input terminal 232 (non-inverting), and provides a voltage on output terminal 233 to drive the gate terminal (G) of pass transistor 240. Voltage 233 may be provided as an amplified difference of the voltages 231 and 232.

Pass transistor 240 passes a current from the source to drain terminals, with the value of the current depending on the gate voltage 233. In general, a conductive path is provided between the source and drain terminals, with the magnitude of the resistance (and thus, the current) being determined by the magnitude of the gate voltage 233. Thus, pass transistor acts as a variable resistor, where gate voltage 233 controls the resistance between source terminal (S) connected to path 244, and drain terminal (D) connected to output node 249

The feedback voltage on terminal 232 is generated by the voltage divider network formed by resistors 250 and 260 (and thus often termed as resistor divider network), and is representative (some fraction, e.g., 0.5 assuming resistors 250 and 260 have equal resistances) of the output voltage 249. Resistors 250 and 260 are selected such that, when output voltage 249 is at the desired level, voltage 232 equals voltage 231 (approximately).

To briefly illustrate the operation of LDO 200, assuming that resistance 290 increases (i.e., current drawn by resistance 290/load reduces), output voltage 249 would be greater than the desired level due to reduced voltage drop across source and drain terminals of pass transistor 240, and voltage 232 would be greater than voltage 231. Consequently, voltage 233 provided by amplifier 230 to gate of pass transistor 240 is increased, thus increasing the resistance of the pass transistor, pass transistor being a PMOS device. As a result, pass transistor 240 drops more voltage across the source and drain terminals, thereby operating to reduce the voltage at node 249.

On the other hand, assuming that resistance 290 decreases (i.e., current drawn by resistance 290 increases), output voltage 249 would be less than the desired level due to the added drop across source and drain terminals of pass transistor 240, and voltage 232 would be less than voltage 231. Consequently, voltage 233 provided to gate of pass transistor 240 may be reduced, decreasing the resistance of the pass transistor. As a result, pass transistor 240 drops less voltage across the source and drain terminals, thereby operating to increase the voltage at node 249. In general, LDO 200 continuously operates to make voltage 231 equal to voltage 232, thereby maintaining output voltage 249 at the desired level.

However, prior LDO 200 may be implemented to have a low gain bandwidth, (representative of how quickly it is able to respond to deviations of the output voltage from the desired value, and operate to correct it). Consequently, when current drawn by resistance 290 increases (for example, a sudden/step increase), LDO 200 may not be able to respond quickly to maintain the output voltage at the desired level (as noted above), and the output voltage may reduce to an unacceptable level, and disrupts the normal operation of circuitry represented by load 290. For example, assuming load 290 represents a processor or a memory, the reduced output voltage may cause a loss of data.

On the other hand, an output voltage higher than the desired level (or beyond an acceptable threshold) may result in damage to the circuitry represented by load 290.

Some prior solutions to the problems noted above include increasing the size of the capacitor 270, and/or designing amplifier 230 as a high speed (high bandwidth) amplifier.

Capacitor 270 (provided external to LDO 200) is used to supply the additional current to resistance 290 when there is a sudden increase in load current (current drawn by resistance 290). However, in supplying the additional current, capacitor 270 discharges, and the output voltage 249 may fall below an acceptable value if LDO 200 does not respond quickly to the change in load current. When load decreases suddenly, capacitor 270 may get over-charged leading to rise in output voltage 249 beyond acceptable levels, causing reliability problems.

Thus, although capacitor 270 may be selected to have larger value (to support larger load variations without significant drop or rise in output voltage), such an approach may cause other undesirable effects, such as increase in regulator startup time, which may not be acceptable. Further, such an approach, may require amplifier 220 to be re-designed for stability (with larger external capacitor), and to support the larger external capacitor, thereby requiring additional power consumption, more chip area, larger volume for external capacitor and/or implementation cost, and may thus not be desirable Implementing amplifier 230 as a high bandwidth amplifier may result in additional power consumption and/or implementation cost, and may thus not be desirable.

Several features of the present invention overcome one or more of the problems described above are described next.

4. Fast Load Regulation

Figure 3:
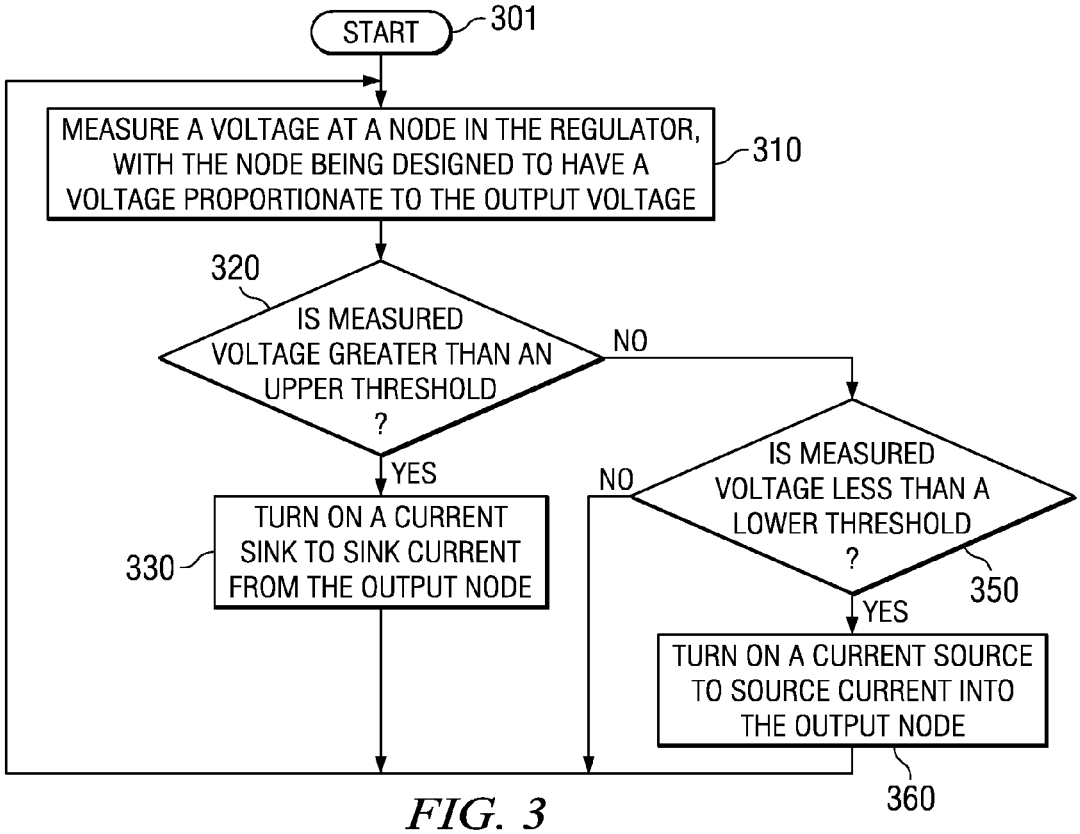
FIG. 3 is a flow chart illustrating the manner in which improved load regulation is provided according to an aspect of the present invention.

FIG. 3 is a flowchart illustrating the manner in which improved load regulation is provided by a regulator in an embodiment of the present invention. The flowchart is described with respect to FIG. 1 merely for illustration. However, various features described herein can be implemented in other environments, as will be apparent to one skilled in the relevant arts by reading the disclosure provided herein. The flowchart starts in step 301 in which control is transferred to step 310.

In step 310, a voltage at a node in the regulator is measured, with the node being designed to have a voltage proportionate to the output voltage. The node (measurement node) may be internal to the regulator. Control then passes to step 320.

In step 320, it is determined whether the measured voltage is greater than a predetermined upper threshold. A measured voltage greater than the predetermined upper threshold may indicate that the output voltage at the output node of the regulator is above a corresponding limit. If the measured voltage is greater than the predetermined threshold, control passes to step 330, otherwise control passes to step 350.

In step 330, a current sink is quickly turned ON to sink current from the output node. The current sink may be provided external to the regulator. The sinking of current by the current sink operates to quickly reduce the voltage at the output node. Control then passes to step 310, in which a new measurement is made and the corresponding steps of the flowchart are performed.

In step 350, it is determined whether the measured voltage is less than a predetermined lower threshold. A measured voltage less than the predetermined lower threshold may indicate that the output voltage at the output node of the regulator is below a corresponding limit. If the measured voltage is less than the predetermined threshold, control passes to step 360, otherwise control passes to step 310.

In step 360, a current source is turned ON to source current into the output node. The sourcing of current by the current source operates to quickly increase the voltage at the output node. Control then passes to step 310.

Thus, according to an aspect of the present invention, a current sink is switched on when the output voltage exceeds the desired level, and a current source is switched on when the output voltage falls below the desired level. The current source and current sink may be designed such that they are switched on very quickly. In an embodiment, the upper and lower predetermined thresholds noted above are the same, though alternative embodiments can be implemented to have different thresholds.

It should be appreciated that the features described above can be realized in various circuit configurations. The description is continued with respect to an example embodiment implementing the features described above.

5. Embodiment of a LDO

Figure 4:
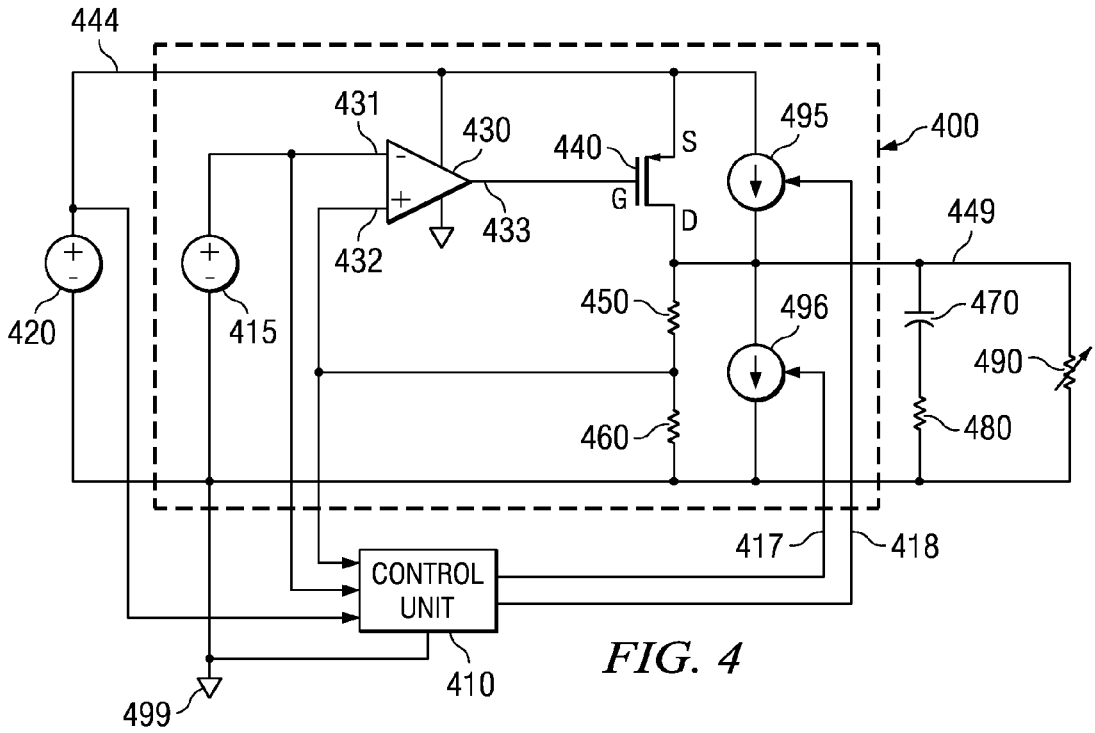
FIG. 4 is a block diagram illustrating the details of a regulator in an embodiment of the present invention.

FIG. 4 is a block diagram illustrating the use of a regulator in an embodiment of the present invention. The diagram is shown containing regulator (LDO) 400, power source 420, external capacitor 470 (in series with ESR resistor 480) and variable resistor 490. The components of FIG. 4 are described in detail below.

Power supply 420, external capacitor 470 and resistor 480 may operate similar to power supply 220, external capacitor 270 and resistor 280 of FIG. 2, and are not described again in detail in the interest of conciseness. Variable resistor 490 represents the variable load presented to the output (output node 449) of regulator 400. With respect to FIG. 1, resistor 490 may represent the combined load presented by ICs 120 and 130.

Regulator 400 receives an unregulated power supply on path 444 and provides a regulated output voltage on output node 449 according to several aspects of the present invention. Regulator 400 is shown containing voltage reference 415, amplifier 430, pass transistor 440, resistors 450 and 460, control unit 410, current source 495 and current sink 496. Voltage reference 415, amplifier 430, pass transistor 440, resistors 450 and 460 operate similar to voltage reference 215, amplifier 230, pass transistor 240, resistors 250 and 260 of FIG. 2, and their description is not repeated in the interest of conciseness. The remaining components are described below in further detail.

When turned on, current sink 496 sinks current from output node 449 to ground 499 (reference terminal), thereby reducing the voltage at node 449. When turned off, current sink 496 may not affect the voltage at node 449. Similarly, when turned on, current source 495 sources current to node 449 from power supply terminal 444, thereby increasing the voltage at node 449. When turned off, current source 495 may not affect the voltage at node 449. In general, the magnitude of current sinked/sourced by current sinks/sources is deterministic, and may be determined based on design or control input, as is well known in the relevant arts.

Control unit 410 receives output 431 of voltage reference 415, and the voltage at measurement node 432. Control unit 410 turns on current source 495 when the voltage at output node 449 is below the ideal constant level and to turn on current sink 496 when the voltage at output node 449 is above the ideal constant level. While the control unit can be implemented based on various techniques as will be apparent to one skilled in the relevant arts by reading the disclosure provided herein, an embodiment described below takes advantage of the circuit existing for the operation of amplifier 430.

In an embodiment, control unit 410 determines if the voltage on measurement node 432 is greater or less than reference voltage 431. If Voltage 432 is greater than voltage 431 (indicating that output voltage 449 is greater than the desired value), control unit 410 switches on current sink 496 to reduce the output voltage 449. Once voltage 432 equals (substantially) voltage 431, control unit 410 turns off current sink 496.

If voltage 432 is less than voltage 431 (indicating that output voltage 449 is greater than the desired value), control unit 410 switches on current source 495 to increase the output voltage 449. Once voltage 432 equals (substantially) voltage 431, control unit 410 turns off current source 495. Control unit may receive power supply connections for operation via paths 444 (power) and 499 (ground).

It should be appreciated that the regulator of FIG. 4 can operate as a linear regulator (LDO) or a switching regulator. In case of a switching regulator, control voltage 433 may be varied at a high frequency to switch transistor 440 between on and off states, thereby providing a desired effective voltage as the output of pass transistor 440. In such a case, the resistance of transistor 440 may be viewed as switched to 0 or infinite in the closed and open states respectively.

On the other hand, in case of linear regulators, control applied (voltage 433 in FIG. 4) is proportional to deviation in required output voltage (voltage 449). In general, the specific resistance of the pass transistor in a linear regulator is controlled by the magnitude of control voltage 433. For example, in case of PMOS transistor 440, the control voltage may be reduced to reduce the resistance, as is well known in the relevant arts.

The internal details of control unit 410, as well as current source 495 and current sink 496, in an example embodiment are described next.

6. Control Unit

Figure 5:
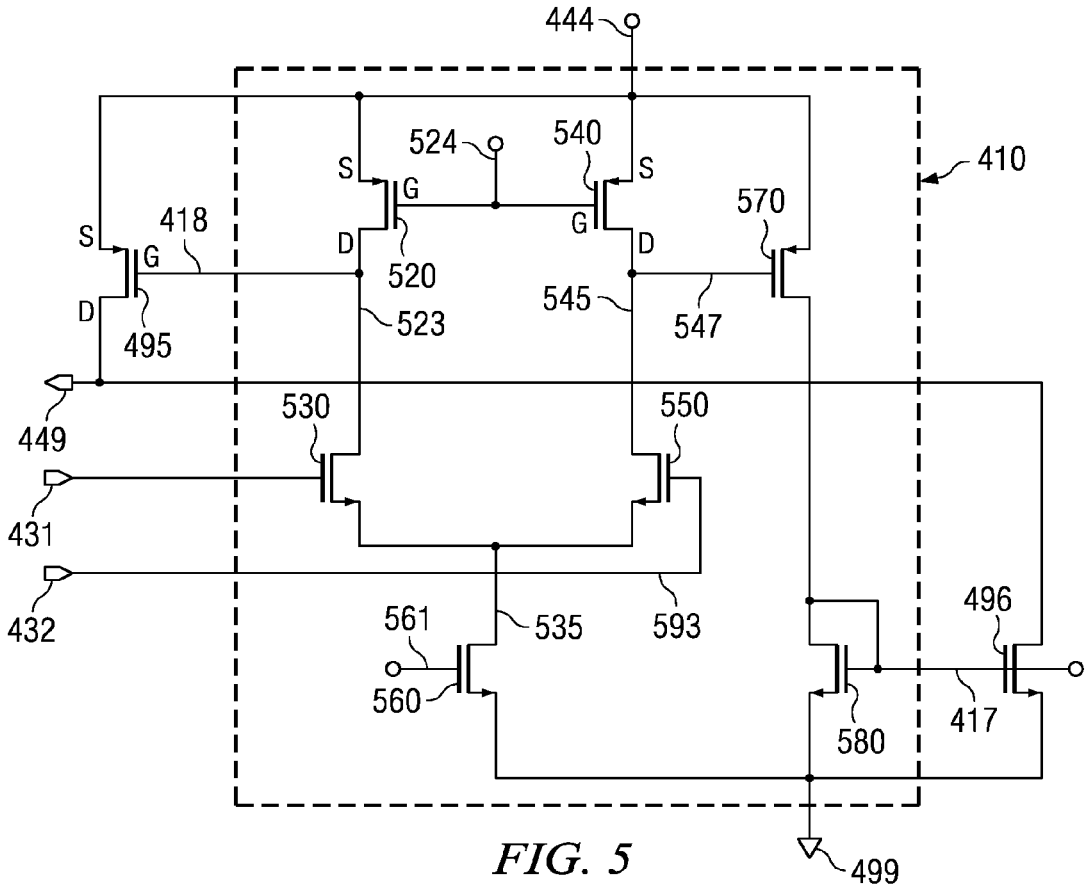
FIG. 5 is circuit diagram illustrating the details of a control unit, current source and a current sink in an embodiment of the present invention.

FIG. 5 is a circuit diagram illustrating the details of a control unit, current source and current sink in an embodiment of the present invention. The diagram is shown containing control unit 410, current source 495 and current sink 496. The operation of the circuit of FIG. 5 is described in detail below.

It should be appreciated that the specific type of transistors (PMOS, NMOS, etc.) are chosen here merely for illustration. However, alternative embodiments using different configurations and transistors will be apparent to one skilled in the relevant arts by reading the disclosure provided herein. For example, the PMOS and NMOS transistors may be interchanged, while also interchanging the connections to power and ground terminals.

Accordingly, in the present application, the power and ground terminals are referred to as reference potentials, the source and drain terminals (though which a current path is provided when turned on and a open path is provided when turned off) are termed as current terminals, and the gate terminal is termed as a control terminal. Furthermore, though the terminals are shown with direct connections to various other terminals, it should be appreciated that additional components (as suited for the specific environment) may also be present in the path, and accordingly the connections may be viewed being electrically coupled to the same connected terminals.

Control unit 410 is shown containing P-type metal oxide semiconductor transistors (PMOS) 520, 540 and 570, and N-type metal oxide semiconductor transistors (NMOS) 530, 550, 560 and 580. Current source is implemented using PMOS 495, while current sink is implemented using NMOS 496. Gate, source and drain terminals of current source 495 as well as PMOS 520 and 540 are marked in FIG. 5 as G, S and D respectively. Corresponding terminals of other transistors have similar meanings.

Voltage at gate terminal 561 of NMOS 560 is provided such that when voltage 431 equals voltage 432, a current (2I) flows on path 535 to ground 499, and a current (I) flows on each of paths 523 and 545. Gate terminals of PMOS 520 and 540 are biased via path 524 such that (ideally) a current I2 flows on each of paths 523 and 545 (when PMOS 520 and PMOS 540 are in saturation), with I2 being greater than I.

However, since current on path 535 is 2I (twice I) when voltage 431 equals voltage 432, PMOS 520 and 540 pass a current (I) each, and operate in the triode (linear) region. As a result, the voltage drop Vds across their respective source and drain terminals is small. Consequently the gate to source voltage Vgs of current source (PMOS) 495 as well as PMOS 570 is less than the threshold voltage Vt. Therefore, PMOS 495 and 570 are off. Since PMOS 570 is off, NMOS 580 and 496 are also off. Thus, when voltage 431 equals voltage 432, current source 495 and current sink 496 are off.

As noted above, when output voltage at output node 449 falls below the desired (set/designed) value, voltage 432 also decreases. Therefore, voltage 431 (which is a fixed voltage provided by voltage reference 415 of FIG. 4) is greater in comparison to voltage 432. As a consequence, current through NMOS 530 (path 523) increases (approaches) I2. The drain to source voltage Vds across PMOS 520 increases. When Vds of PMOS 520 exceeds threshold voltage Vt, current source 495 switches on, and supplies current to output node 449, thereby raising output voltage 449.

The loop formed by amplifier 430, pass transistor 440 and resistors 450 and 460 (FIG. 4) eventually responds to the (initial) drop in the output voltage, and operates to maintain (regulate) the output voltage constant, in a manner described above with respect to FIG. 2.

Figure 6A:
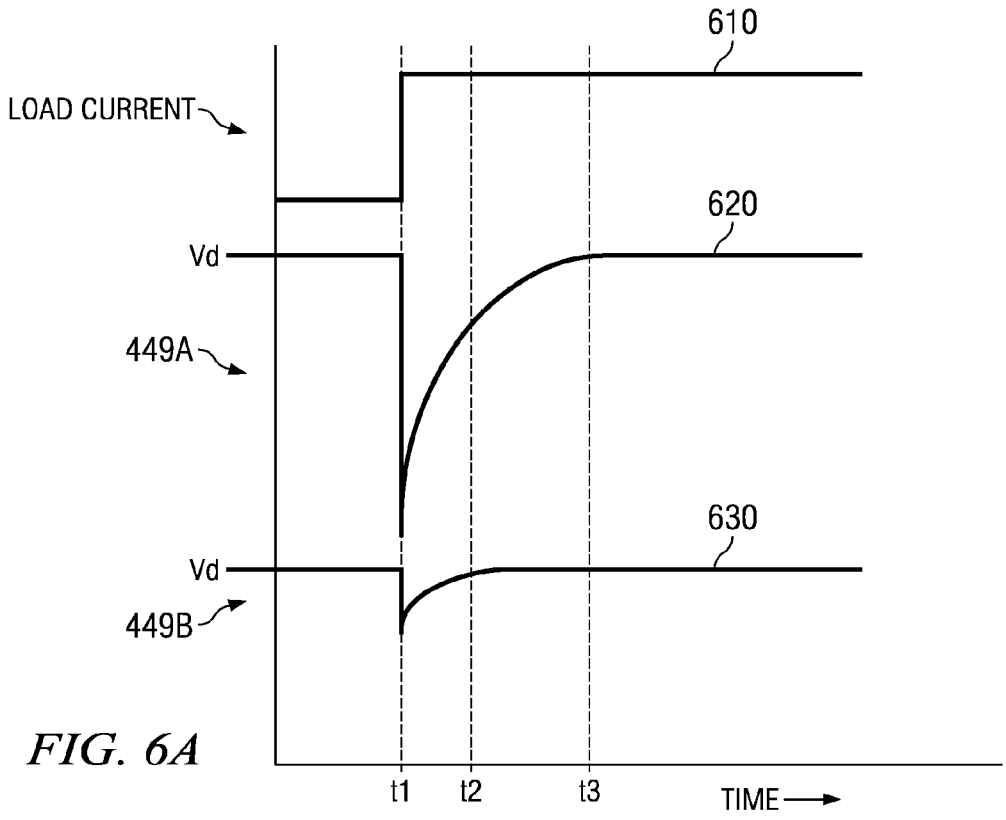
FIG. 6A is a timing diagram illustrating the improved regulation when the load current increases.

FIG. 6A is a diagram of example waveforms illustrating the improved load regulation provided by control unit 410 (in conjunction with current source 495). The diagram is not drawn to scale and is merely intended to illustrate the applicable concepts generally. Waveform 610 represents the current drawn by load 490. Waveform 449A represents the output voltage 449 in the absence of control unit 410 and current source 495 (for example, similar to the prior embodiment of FIG. 2). Waveform 449B represents the output voltage 449 in an embodiment of the present invention (e.g., FIG. 4)

At time instance t1, load current is shown as having a step increase. Assuming the desired (ideal) output voltage is Vd, waveform 449A shows a decrease in Vd, which is corrected only by time instance t3. Waveform 449B also shows a decrease in Vd at time instance t1, but is corrected at instance t2. It may be appreciated that the maximum dynamic drop in voltage from Vd in waveform 449B is less, and the time to stabilize the output voltage is also reduced (as compared to waveform 449A).

When output voltage at output node 449 rises above the desired (set/designed) value, voltage 432 also increases. Therefore, voltage 432 is greater in comparison to voltage 431. As a consequence, current through NMOS 550 (path 545) increases (approaches) I2. The drain to source voltage Vds across PMOS 540 increases. When Vds of PMOS 540 exceeds threshold voltage Vt, PMOS 570 switches on, thereby switching on NMOS 580. Since NMOS 580 and current sink (NMOS) 496 are current mirror pairs (with same current density and some fixed current ratio between them), current sink 496 is switched on, and sinks current from output node 449, thereby lowering output voltage 449.

The loop formed by amplifier 430, pass transistor 440 and resistors 450 and 460 (FIG. 4) eventually responds to the (initial) rise in the output voltage, and operates to maintain (regulate) the output voltage constant, in a manner described above with respect to FIG. 2.

Figure 6B:
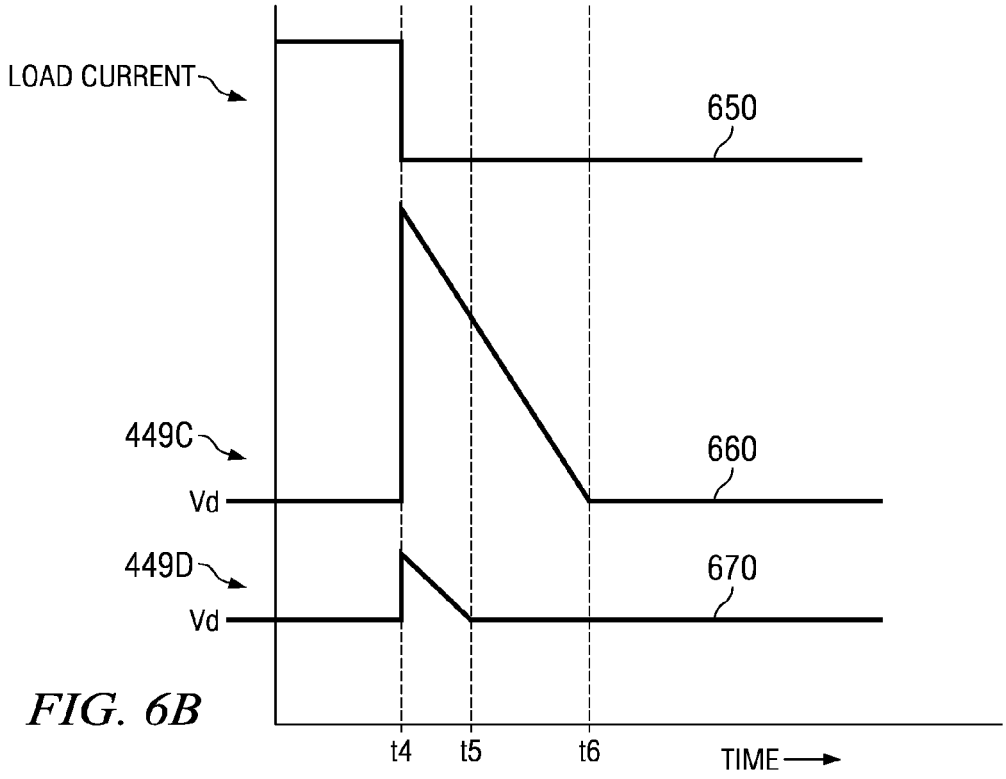
FIG. 6B is a timing diagram illustrating the improved regulation when the load current decreases.

FIG. 6B is a diagram of example waveforms illustrating the improved load regulation provided by control unit 410 (in conjunction with current sink 496). Waveform 650 represents the current drawn by load 490. Waveform 449C represents the output voltage 449 in the absence of control unit 410 and current sink 496. Waveform 449D represents the output voltage 449 in an embodiment of the present invention (e.g., FIG. 4).

At time instance t4, load current is shown as having a step decrease. Assuming the desired (ideal) output voltage is Vd, waveform 449C shows an increase in Vd occurring at time instance t4, which is corrected only by time instance t6. Waveform 449D also shows an increase in Vd at time instance t4, but is corrected at time instance t5. It may be appreciated that the maximum dynamic rise in voltage from Vd in waveform 449D is reduced, and the time to stabilize the output voltage is also reduced (as compared to waveform 449C).

It may be appreciated that control unit 410 in conjunction with current source 495 and current sink 496 operates to quickly correct any variation in output voltage 449. Thus, amplifier 430 may be implemented as a comparatively low bandwidth amplifier, while regulator 400 still provides quick (improved) load regulation.

With respect to the circuit of FIG. 5, in order to sink current by NMOS 496, first PMOS 570 needs to switch on and start charging the capacitance at node 417 (the capacitance being the gate to source capacitance of NMOS 580 and NMOS 496 and drain to body capacitance of NMOS 580). NMOS 496 may start sinking the desired current only once this capacitance is charged. On the other hand, the sourcing of current by PMOS 495 is relatively fast. Therefore, it may be noted that the time taken to switch on current sink 496 may be greater in comparison to the time taken to switch in current source 495. An alternative embodiment of a control unit and corresponding current source and current sink overcomes the problem noted above, and is described next.

7. Alternative Embodiment

Figure 7:
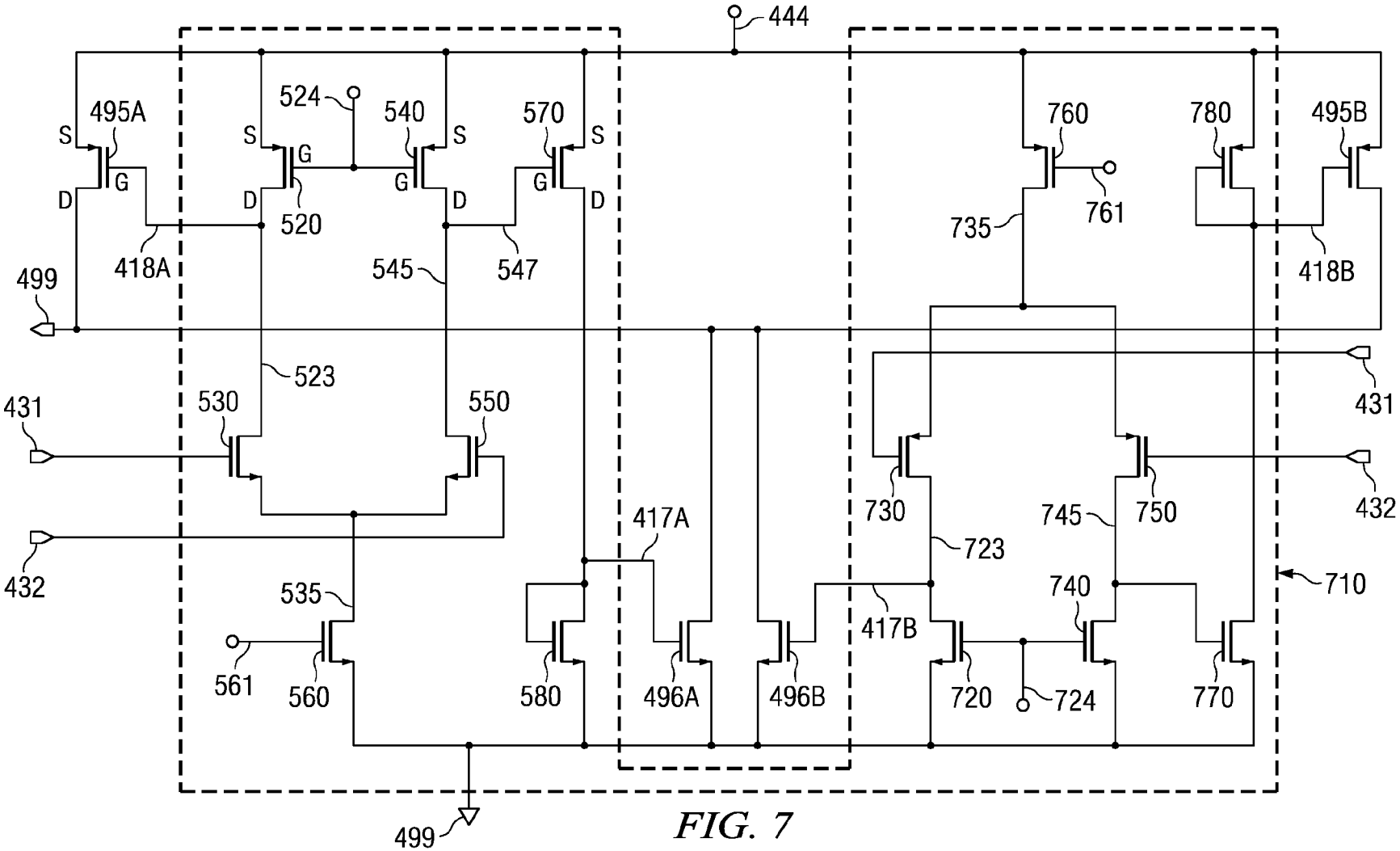
FIG. 7 is a circuit diagram illustrating the details of a control unit, current source and a current sink in another embodiment of the present invention.

FIG. 7 is a circuit diagram illustrating the details of a control unit, current source and current sink in an alternative embodiment of the present invention. The diagram is shown containing the details of control unit 710, current source 495 and current sink 496 in one embodiment. The operation of the circuit of FIG. 7 is described in detail below.

Control unit 710 is shown containing PMOS 520, 540 and 570, and NMOS 530, 550, 560 and 580, as well as NMOS 720, 740 and 770, and PMOS 730, 750, 760 and 780. Current source 495 is implemented by the combination of PMOS 495A and PMOS 495B. Current sink 496 is implemented by the combination of NMOS 496A and NMOS 496B. Voltages 431 and 432 are applied to gate terminals of each of transistors 530, 550, 730 and 750.

The portion containing PMOS 520, 540 and 570, and NMOS 530, 550, 560 and 580 operates similar to the correspondingly numbered portions of control unit 410 (FIG. 5), and their description is not repeated in the interest of conciseness.

The portion of control unit 710 containing NMOS 720, 740 and 770, and PMOS 730, 750, 760 and 780 represents a "mirror" circuit of the portion containing PMOS 520, 540, 570 and NMOS 530, 550, 560 and 580, with a PMOS transistor replaced by an NMOS transistor, along with the required changes to power and ground connections. In general, a mirror implies that the transistor types are changed with corresponding changes required to the ground/power connections.

To illustrate, PMOS 760 in the "mirror" portion corresponds to NMOS 560. Similarly, PMOS 730, 750, 780 correspond to NMOS 530, 550 and 580. NMOS 720, 740 and 770 correspond to PMOS 520, 540 and 570.

Similar to the corresponding transistor 560, the voltage at gate terminal 761 of PMOS 760 is provided such that when voltage 431 equals voltage 432, a current (I) flows on each of paths 723 and 745. Gate terminals of NMOS 720 and 740 are biased via path 724 such that (ideally) a current I2 flows on each of paths 723 and 745 (when NMOS 720 and NMOS 740 are in saturation), with I2 being greater than I.

However, since current on path 735 is 2I (twice I) when voltage 431 equals voltage 432, NMOS 720 and 740 pass a current (I) each, and operate in the triode (linear) region, and NMOS 496B, 770, PMOS 780 and 495B are also off. Thus, when voltage 431 equals voltage 432, current source portion 495B and current sink portion 496B are off. It may be noted that, the corresponding current source portion 495A and current sink portion 496A are also off.

When output voltage at output node 449 rises above the desired (set/designed) value, voltage 432 also increases. Therefore, voltage 432 is greater in comparison to voltage 431. As a consequence, current through PMOS 730 (path 723) increases (approaches) I2. The drain to source voltage Vds across NMOS 720 increases. When Vds of NMOS 720 exceeds threshold voltage Vt, current sink portion 496B switches on. It may be noted that corresponding current sink portion 496A, may be switched on after a delay as noted above. Thus, the slow operation of current sink portion 496A is countered by the fast acting operation of current sink portion 496B, and overcomes the problem noted above with respect to FIG. 5.

The operation of the circuit of FIG. 7 for the condition when output node 449 falls below the set value is not described in detail as being apparent to a skilled practitioner based on the above. It is merely noted that for such a condition, current source portion 495B (which is a slow acting current source, due to reasons similar to those noted above with respect to current sink 496 of FIG. 5) is turned on (after a delay) in addition to current source 495A.

Thus, the embodiment of FIG. 7 provides fast response, and hence improved load regulation for both of conditions, output voltage 449 falling below as well as rising above the desired value.

While FIG. 7 is shown with additional transistors having a mirror configuration of the transistors of FIG. 5, it should be appreciated that the circuit of FIG. 5 can be implemented using different number of transistors/configuration, and FIG. 7 can be accordingly modified for the corresponding mirror configuration.

Due to the features thus described, regulators provided according to several aspects of the present invention may be used in various environments in which load current can vary substantially and yet a constant voltage supply is required. Examples of such environments include processors, memories, high performance analog to digital converter (ADCs), etc.

8. Conclusion

While various embodiments of the present invention have been described above, it should be understood that they have been presented by way of example only, and not limitation. Thus, the breadth and scope of the present invention should not be limited by any of the above-described embodiments, but should be defined only in accordance with the following claims and their equivalents.

What is claimed is:

1. A regulator to provide an output voltage of a constant level at an output node, said regulator comprising:

a pass transistor to provide a conductive path between a pair of terminals of said pass transistor, wherein a resistance offered by said conductive path is determined by a control voltage on a third terminal of said pass transistor, said conductive path coupling a first reference potential to said output node;

an amplifier to generate said control voltage based on a difference of a reference voltage and a voltage proportionate to said output voltage;

a current source to source current to said output node when turned on;

a current sink to sink current from said output node when turned on;

a control unit to turn on said current source when voltage at said output node is below said constant level and to turn on said current sink when voltage at said output node is above said constant level;

a voltage divider circuit coupled between said output node and a second reference potential, and to provide said voltage as a fixed fraction of the strength of said output voltage at a measurement node;

wherein said control unit contains a first plurality of transistors comprising:

a first transistor with a first current terminal coupled to said second reference potential and a control terminal coupled to a bias voltage;

a second transistor with a first current terminal coupled to a second current terminal of said first transistor, and a control terminal coupled to said measurement node;

a third transistor with a first current terminal coupled to said second current terminal of said first transistor, and a control terminal coupled to said reference voltage;

a fourth transistor with a first current terminal coupled to said first reference potential and a second current terminal couple to a second current terminal of said second transistor and a control terminal coupled to a second bias voltage;

a fifth transistor with a first current terminal coupled to said first reference potential and a second current terminal couple to a second current terminal of said third transistor and a control terminal coupled to said second bias voltage;

a sixth transistor with a first current terminal coupled to said first reference potential and a control terminal coupled to said second current terminal of said fourth transistor; and a seventh transistor with a first current terminal coupled to said second reference potential and a second current terminal coupled to a second current terminal of said sixth transistor, said second current terminal of said seventh transistor also coupled to a control terminal of said seventh transistor.

2. The regulator of claim 1, wherein said control unit is designed to compare said reference voltage and said voltage proportionate to said output voltage, and to turn on said current source when said voltage is less than said reference voltage and to turn on said current sink when said voltage is greater than said reference voltage.

3. The regulator of claim 1, wherein control applied to said pass transistor is proportional to deviation in said output voltage.

4. The regulator of claim 1, wherein said first plurality of transistors are according to a first configuration, said control unit further comprising a second plurality of transistors according to a second configuration, wherein said first configuration is a mirror of said second configuration.

5. The regulator of claim 4, wherein said current source comprises a eighth transistor with a first current terminal coupled to said first reference potential, a second current terminal coupled to said output node and a control terminal coupled to said second current terminal of said fifth transistor.

6. The regulator of claim 4, wherein said current sink comprises a ninth transistor with a first current terminal coupled to said second reference potential, a second current terminal coupled to said output node and a control terminal coupled to said control terminal of said seventh transistor.

7. The regulator of claim 4, wherein said first bias voltage is selected to cause a current of value I to flow through each of said second transistor and said third transistor when said reference voltage equals said voltage proportionate to said output voltage.

8. The regulator of claim 7, wherein said second bias voltage is selected to cause said fourth transistor and said fifth transistor to operate in a linear region when said reference voltage equals said voltage proportionate to said output voltage.

* * * * *